US011607030B1

(12) United States Patent
Bell

(10) Patent No.: US 11,607,030 B1
(45) Date of Patent: Mar. 21, 2023

(54) ACCESSORY ATTACHMENT ASSEMBLY FOR A GARMENT AND A GARMENT WITH AN ACCESSORY ATTACHMENT ASSEMBLY

(71) Applicant: Kathryn A. Bell, New Smyrna Beach, FL (US)

(72) Inventor: Kathryn A. Bell, New Smyrna Beach, FL (US)

( * ) Notice: Subject to any disclaimer, the term of this patent is extended or adjusted under 35 U.S.C. 154(b) by 185 days.

(21) Appl. No.: 16/984,598

(22) Filed: Aug. 4, 2020

Related U.S. Application Data

(60) Provisional application No. 62/922,382, filed on Aug. 5, 2019.

(51) Int. Cl.
*A45F 5/02* (2006.01)

(52) U.S. Cl.
CPC ..... *A45F 5/02* (2013.01); *A45F 2005/023* (2013.01)

(58) Field of Classification Search
CPC ..... A45F 5/02; A45F 2005/023; Y10T 24/13; Y10T 24/1397; Y10T 24/318
See application file for complete search history.

(56) References Cited

U.S. PATENT DOCUMENTS 1,116,307 A 11/1914 Lynch
1,361,565 A * 12/1920 Christy ..... A41D 19/0041 2/160
2,738,512 A 3/1956 Melvin
3,555,567 A 1/1971 Owen
3,997,921 A 12/1976 Knight
4,475,252 A 10/1984 Peyser et al.
4,879,769 A * 11/1989 Grilliot ..... A41D 13/0005 2/312
4,947,489 A 8/1990 Greenwood
4,985,968 A 1/1991 Hooper
5,131,096 A 7/1992 Olson
5,170,505 A 12/1992 Rohrer
5,692,239 A 12/1997 Lewis
5,950,240 A 9/1999 Carpenter et al.
5,974,591 A * 11/1999 Leslie ..... A41F 17/00 2/81
6,223,352 B1 5/2001 Watlington
6,247,183 B1 6/2001 Haas-Laursen
(Continued)

FOREIGN PATENT DOCUMENTS

AU 2006100151 A4 5/2006
CN 201323884 10/2009
(Continued)

*Primary Examiner* — Robert Sandy
(74) *Attorney, Agent, or Firm* — Gerben Perrott, PLLC; Benjamin M. Hanrahan

(57) ABSTRACT

An accessory attachment assembly for a garment and a garment with an accessory attachment assembly are disclosed herein. In particular, the accessory attachment assembly includes a first base disposed on an exterior surface of the garment and a second base disposed on an interior of the garment in an at least partially aligned relation to one another. A strap extends from one end of the first base and is disposable between an at least partially open position and a closed position via cooperative first and second fastener defining a loop and allowing for the removable attachment of an accessory. A third fastener is attached to the second base allowing for the removable attachment of an additional accessory thereto.

19 Claims, 11 Drawing Sheets

(56) References Cited

U.S. PATENT DOCUMENTS

| | | | | |
|---|---|---|---|---|
| 6,656,516 | B1 | 12/2003 | Frost et al. | |
| 7,086,121 | B2 | 8/2006 | Lippincott | |
| 7,725,954 | B2 | 6/2010 | DelPrete et al. | |
| 7,725,958 | B1 | 6/2010 | Gilmore | |
| 9,089,169 | B1 | 7/2015 | Covo et al. | |
| 9,173,442 | B2 | 11/2015 | Tyson et al. | |
| 2006/0168766 | A1 | 8/2006 | Lippincott | |
| 2006/0174394 | A1 | 8/2006 | Kelly | |
| 2008/0276431 | A1 | 11/2008 | DelPrete et al. | |
| 2009/0126071 | A1 | 5/2009 | Salvanto | |
| 2009/0255028 | A1 | 10/2009 | Weisblatt | |
| 2009/0320173 | A1 | 12/2009 | Markowitz | |
| 2010/0082063 | A1* | 4/2010 | Yacktman ..... | A61J 17/111<br>606/234 |
| 2016/0353809 | A1 | 12/2016 | Barski | |
| 2019/0045849 | A1 | 2/2019 | Takasaki | |

FOREIGN PATENT DOCUMENTS

| | | | |
|---|---|---|---|
| DE | 202015000081 | U1 | 2/2015 |
| JP | 3185320 | U | 8/2013 |
| WO | 0247500 | A2 | 6/2002 |

* cited by examiner

ACCESSORY ATTACHMENT ASSEMBLY FOR A GARMENT AND A GARMENT WITH AN ACCESSORY ATTACHMENT ASSEMBLY

CLAIM OF PRIORITY/CROSS-REFERENCE TO RELATED APPLICATION

The present application is based on and a claim of priority is made under 35 U.S.C. § 119(e) to provisional patent application Ser. No. 62/922,382, having a filing date of Aug. 5, 2019, the contents of which are incorporated herein in their entirety by reference.

FIELD OF THE INVENTION

The present invention is generally directed to articles of clothing or garments, and more specifically to an accessory attachment assembly for a garment or a garment with one or a plurality of accessory attachment assemblies disposed thereon.

BACKGROUND OF THE INVENTION

Traditional children's garments do not allow for the temporary or removable attachment of accessories or add-ons, such as, for example, hand/foot coverings, medical equipment, teething accessories, pacifiers, toys, etc. Rather, hand/foot coverings of traditional children's garments are either permanently attached or fixed to the main body of the garment or non-existent and must be added in the form of socks, shoes, gloves, mittens, booties, etc. that can be easily pulled off by the wearer or can fall off and become misplaced, lost or stolen. Furthermore, unattached accessories or add-ons often fall to the floor when not secured to the child or garment and can become unsanitary, misplaced or lost.

Accordingly, there is a need in the art for a novel accessory attachment assembly that is secured to the garment or article of clothing, such as, but not limited to a shirt, pajamas, onesie, pants, shorts, etc., and which allows for the removable attachment of one or more accessories or add-ons, such as, for example, pacifiers, utensils, drinking vessels, toys, teething devices, medical equipment or tubing, as well as hand/foot coverings, such as gloves, mittens, socks, booties, shoes, etc. It would also be beneficial if the proposed accessory attachment assembly is disposed proximate an opening of the garment, such as, at or near an arm opening, leg opening, neck opening, bottom opening or hem, top opening or hem, pocket opening, etc. and to which accessories or add-ons are able to attach both on the exterior of the garment and on the interior of the garment.

SUMMARY OF THE INVENTION

Accordingly, at least one embodiment of the present invention is generally directed to an accessory attachment assembly for a garment or article of clothing, while other embodiments are directed to a garment or article of clothing with an accessory attachment assembly disposed thereon. In particular, as described herein, the accessory attachment assembly of the various embodiments is structured and configured to allow for the removable attachment of one or more accessories or other items to the garment, including, but in no way limited to a pacifier, medical equipment, hand/foot coverings, teething accessories, toy, strap, lanyard, glove, mitten, sock, etc. Furthermore, as will become apparent from the description provided herein, the accessory attachment assembly of at least one embodiment includes a plurality of different attachment portions, such as a first attachment portion disposed on an external surface of the garment and a second attachment portion disposed on an internal surface of the garment. This allows certain accessories to be attached to the first attachment portion external to the garment and different accessories attached to the second attachment portion at least partially internal to the garment.

More specifically, the accessory attachment assembly of at least one embodiment includes a first base attached to an external surface of the garment and a second base attached to the internal surface of the garment. In many cases, the first and second base are at least partially aligned or otherwise overlapping with one another, and in some cases attached to one another via a plurality of stitching disposed through both of the bases and the layer of garment disposed there between.

Moreover, a strap or attachment strip extends from the first base on the external surface of the garment. The strap is disposable between an at least partially open position and an at least partially closed position defining a closed loop. When the strap is open or at least partially open, an accessory or other item may be placed in between the strap and the first base wherein the strap can then be closed, forming the closed loop, and securing the accessory therein.

Furthermore, the accessory attachment assembly may include a fastener pair structured and configured to allow for the removable attachment of the strap to the first base. In this manner, one half of the fastener pair may be attached to the first base, while the other half of the fastener pair may be attached to the strap. In some embodiments, the fastener pair may be in the form of snap fasteners, wherein one half of the fastener pair is a female snap fastener and the other half is a male snap fastener. Other fastener pairs are contemplated within the full spirit and scope of the present invention, including but not limited to hook and loop type fasteners (e.g., VELCRO®), a button and corresponding button opening, clips, clamps, etc.

Additionally, certain embodiments of the present invention also define a second attachment portion disposed on the interior of the garment. For example, the second base disposed on the interior surface of the garment may include a fastener to which an additional accessory may be attached. In one embodiment, the fastener on the second base may be one half of a fastener pair (e.g., a male or female snap fastener, hook or loop fastener, button, snap, clip, etc.) to with a cooperating fastener disposed on an accessory or auxiliary item, such as a glove, mitten, sock, child leash, or decorative item (e.g., a character or decorative feature protruding from a pocket opening) can be attached. In other embodiments, it is contemplated that a second strap, similar in function and construction as the strap attached to the first base, can be attached to the second base on the interior of the garment, forming a loop to which an accessory can attach.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
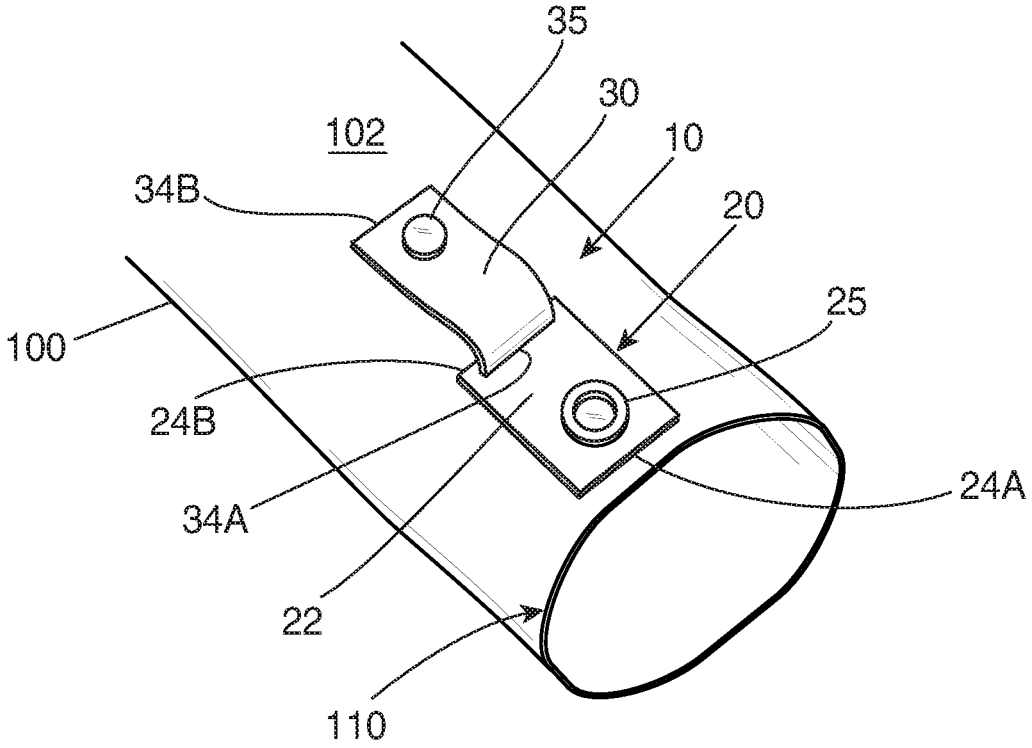
FIG. 1A is a top perspective view of the accessory attachment assembly disposed in an open position as disclosed in accordance with at least one embodiment of the present invention.
Figure 1B:
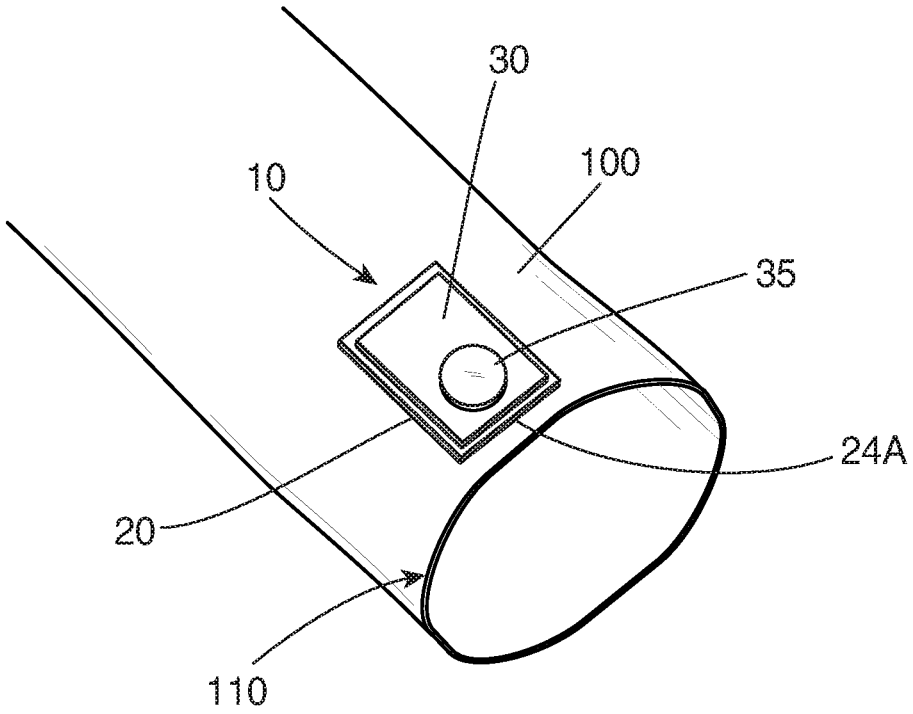
FIG. 1B is a top perspective view of the accessory attachment assembly disposed in a closed position as disclosed in accordance with at least one embodiment of the present invention.

As shown in the accompanying drawings, and with particular reference to FIGS. 1A and 1B, at least one embodiment of the present invention is directed to an accessory attachment assembly 10 for a garment or article of clothing 100. Other embodiments are directed to a garment or article of clothing 100 with an accessory attachment assembly 10 disposed thereon. In particular, as described herein, the accessory attachment assembly 10 of the various embodiments is structured and configured to allow for the removable attachment of one or more accessories 150 or other items to the garment 100, and in particular to a first attachment portion disposed on an external surface of the garment 100 and/or a second attachment portion disposed on an internal surface of the garment 100.

Furthermore, it should be noted that the garment or article of clothing 100, as used herein, can be virtually any clothing item or apparel, including, but in no way limited to a t-shirt, long sleeve shirt, pajamas (e.g., pajama shirts, pajama shorts and/or pajama pants), onesies, pants, shorts, etc. It should also be noted that while a number of embodiments disclosed herein are intended for use with or include children's clothing or baby clothing, the full spirit and scope of the present invention is not limited to such in that clothing intended for use by any age group including babies, children, adults, and elderly are contemplated.

With reference again to FIGS. 1A and 1B, for example, the accessory attachment assembly 10 of at least one embodiment includes a first base 20 or layer fixed or secured to an exterior surface 102 of the garment 100. The first base 20 can be made of a durable woven or nonwoven material or fabric and can be attached to the garment 100 via stitching, as described herein, although other materials and other methods of attachment to the garment 100 are included with the scope of some embodiments of the present invention.

Furthermore, attached to or extending from a top or exposed surface 22 of the first base 20 is a first fastener 25. As shown in the drawings, the first fastener 25 is attached or connected to the first base 20 at or near at least one of the ends, such as, for example, a proximate end 24A thereof, or otherwise offset from the center of the first base 20. In this manner, there is an open space defined as being between the first fastener 25 and the distal end 24B of the first base 20 or layer that will at least partially define the first attachment portion or loop to which an accessory or auxiliary item may be attached. In other embodiments, the first fastener 25 may be attached or connected to the first base 20 in different locations thereon, including, for example, at or near the distal end 24B or at or near the center.

In some embodiments, the first fastener 25 is one half of a snap fastener pair, such as a female snap fastener or a male snap fastener. More in particular, a snap fastener pair, sometimes referred to as a press stud, is a pair of interlocking fasteners where a protrusion on one of the fasteners (i.e., the male snap fastener) engages or fits within a socket of the other snap fastener (i.e., the female snap fastener). The two fasteners are held together (e.g., via one or more grooves and lips) until an amount of separating force is applied.

Still referring to FIGS. 1A and 1B, at least one embodiment of the present invention also includes a strap 30 disposable between an at least partially open or removed position (e.g., FIG. 1A) and a closed or attached position (e.g., FIG. 1B) relative to the first base 20, and in particular, the first fastener 25 thereof. Specifically, as shown in FIG. 1A, for example, in one embodiment a proximal end 34A of the strap 30 is attached or secured to the first base 20. In some cases, the strap 30 may be attached or secured to the first base 20 at or near an end of the first base 20 that is opposite the first fastener 25. For example, in the embodiment shown, the first fastener 25 is attached to the proximal end 24A of the first base 20. In that case, the strap 30 may be attached to the first base 20 at or near the opposing distal end 24B. Conversely, if the first fastener 25 is disposed at or near the distal end 24B of the first base 20, the strap 30 may be attached to the first base 20 at or near the opposing proximal end thereof. Again, this defines a space between the first fastener 25 and the strap 30 which at least partially defines the first attachment portion or loop of at least one embodiment.

Moreover, the strap 30 of at least one embodiment may be attached or secured to the first base 20 via via stitching, adhesive, etc. It is also contemplated that in certain embodiments, the first base 20 and the strap 30 are integral or otherwise constructed of a single or continuous piece such that the strap 30 is a continuous portion of the first base 20 that extends from an end 24A, 24B thereof.

It should be noted that, an additional exterior base (not shown) attached or sewn to the exterior surface 102 of the garment 100, for example, adjacent to, spaced from or otherwise longitudinally aligned with the first base 20 may be included. For instance, the additional exterior base may be similar in construction and size as the first base and spaced from or adjacent to end 24. In any case, the strap 30 may be attached or secured to the additional exterior base, in some cases.

In some embodiments, the strap 30 may have at least some elasticity meaning that it can at least partially stretch and then return to its original shape. In this manner, the strap 30 may be constructed of an elastic material or a material that includes some lengthwise elasticity. In particular, the elasticity of the strap 30 may be lengthwise, for example, allowing the strap 30 to stretch longitudinally between the proximal end 34A to the distal end 34B. The elasticity of at least one embodiment can absorb some of the force applied to the strap 30, for example, if a child forcibly pulls on the accessory 150 (e.g., pacifier, toy, etc.) attached to the assembly 10. In other embodiments, the strap 30 may have little or no elasticity and may be constructed out of a durable woven or nonwoven material or fabric.

Additionally, in at least one embodiment, a second fastener 35 is disposed on or attached to the strap 30, for example, adjacent a distal end 34B thereof. The second fastener 35 is cooperative with the first fastener 25 disposed on the first base 20, such that first and second fasteners 25, 35 are removably connectable to one another. More specifically, in the example provided above wherein the first fastener 25 is one half of a snap fastener pair, the second fastener 35 is the other half of the snap fastener pair. In this manner, and in one embodiment, the first fastener 25 is a female snap fastener with the second fastener 35 being a cooperative male snap fastener. In other embodiments, the first fastener 25 may be a male snap fastener with the second fastener 35 being a cooperative female snap fastener. In yet other embodiments, first and second fasteners 25, 35 may be other types of cooperating fasteners including but in no way limited to clips, hooks, hook and loop type fasteners (e.g., VELCRO®), clamps, etc. For example, the first fastener 25 may be a button, with the second fastener being a cooperative opening through which the button is disposed or engages.

Figure 2:
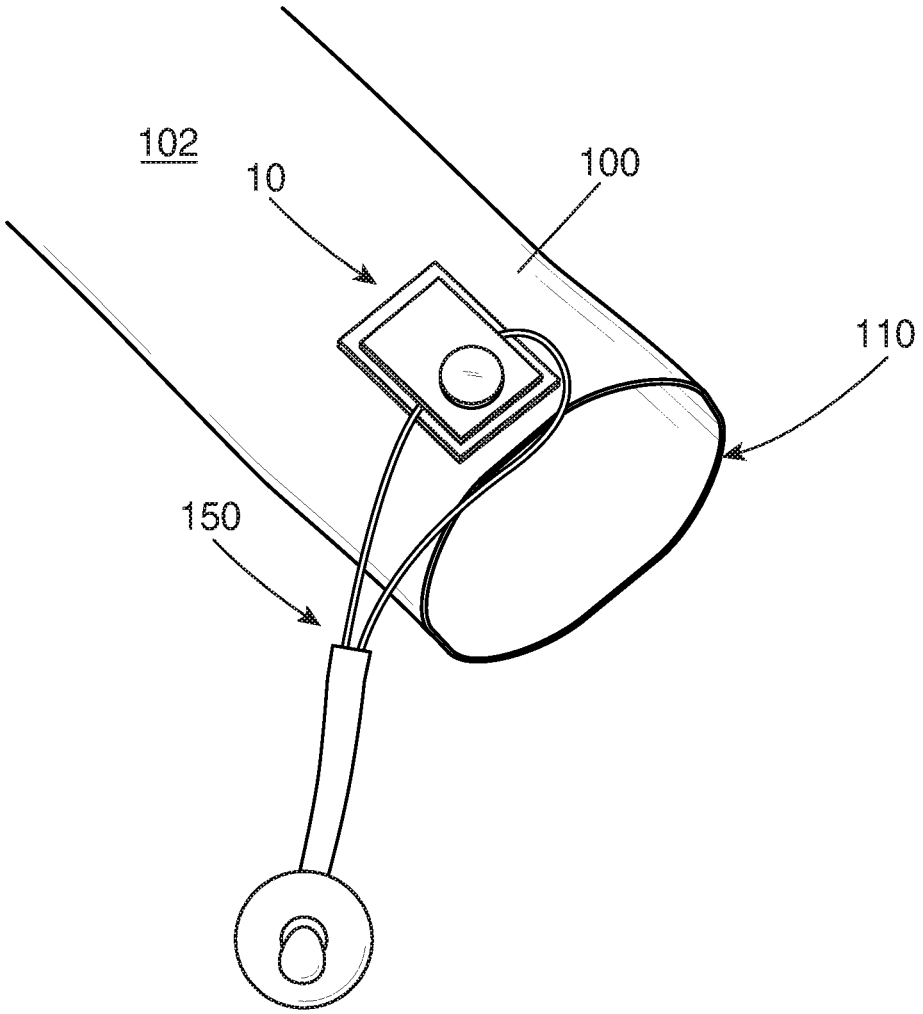
FIG. 2 is a top perspective view of the accessory attachment assembly with a pacifier and pacifier strap attached thereto in accordance with at least one embodiment of the present invention.

More in particular, with the strap 30 disposed in the closed position, a closed loop is formed via the strap 30 and the first base 20. In this manner, as generally shown in FIG. 2, for example, an accessory or item 150, such as a pacifier, pacifier strap, or tether can be engaged within the closed loop of the accessory attachment assembly 10 and attached to the garment 100. For instance, with the loop open or otherwise with the strap 30 disposed in the at least partially open position (e.g., FIG. 1A), the accessory 150 can be placed in the open space (e.g., on the top surface 22 of the first base 20 between the strap 30 and the first fastener 25. The strap 35 can then be disposed in the closed positioned by connecting first and second fasteners 25, 35, thereby enclosing or engaging the accessory 150 within the formed loop.

It should be noted that the accessory or item 150 used in connection with at least one embodiment of the present invention and secured or connected to the accessory attachment assembly 10 via the strap 30 and loop formed thereby can be virtually any accessory or item capable of being secured in this manner, including, but not limited to a pacifier, pacifier strap, toy, a decorative item, a leash, etc.

Figure 3B:
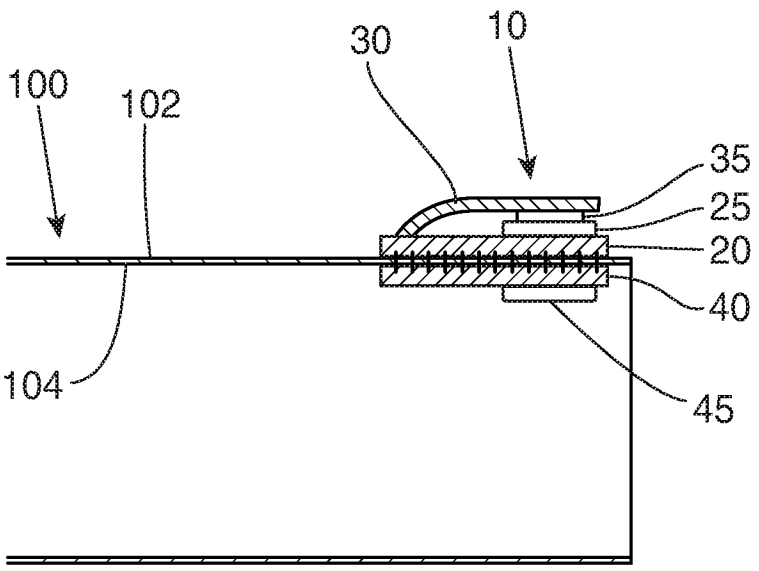
FIG. 3B is a cut away view of the accessory attachment assembly disposed in a closed position as disclosed in accordance with at least one embodiment of the present invention.
Figure 3A:
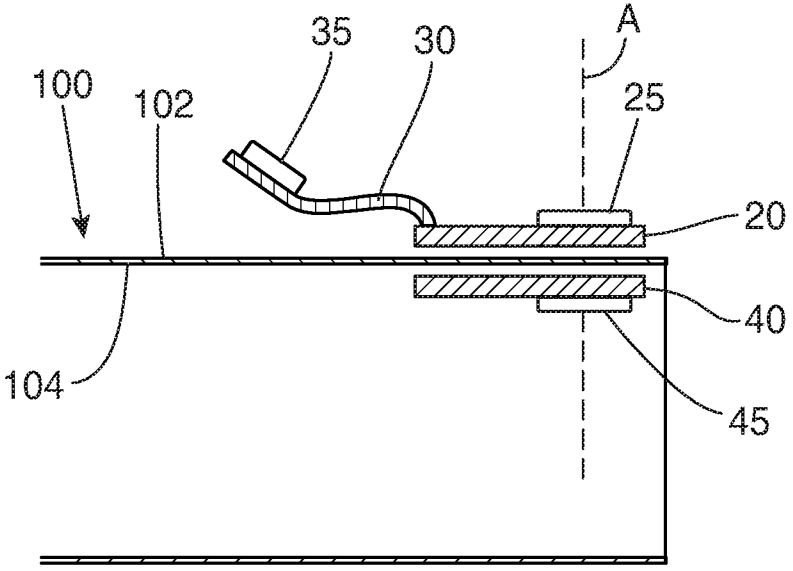
FIG. 3A is cut away view of the accessory attachment assembly disposed in an open position as disclosed in accordance with at least one embodiment of the present invention.

With reference now to FIGS. 3A and 3B, cut-away views of the accessory attachment assembly 10 of at least one embodiment are shown with loop open (FIG. 3A) and closed (FIG. 3B). In particular, a second base 40 disposed on an interior surface 104 of the garment 100 is shown. In at least one embodiment, the second base 40 is identical or similar in construction and size as the first base 20, although the first and second bases 20, 40 may be of different size and/or shape. In any event, in at least one embodiment, the first base 20 and second base 40 may be aligned with one another or layered such that they first and second bases 20, 40 can be attached to one another through the garment 100.

More in particular, in at least one embodiment, the first and second bases 20, 40 are attached to one another with the garment 100 disposed there between. Specifically, the first and second bases 20, 40 may be sewn together via a plurality of stitches that pass through both of the bases 20, 40 and the garment 100. Layering the first and second bases 20, 40 and sewing them together in this manner provides increased durability while reducing the labor and overall costs of production.

Furthermore, still referring to FIGS. 3A and 3B, in at least one embodiment a third fastener 45 is disposed on the second base 40, such as on an inner surface 42 thereof. As shown in the drawings, the third fastener 45 is attached or connected to the second base 40 at or near at least one of the ends, such as, for example, a proximate end 44A thereof, or otherwise offset from the center of the first base 40. In other embodiments, the third fastener 45 may be attached or connected to the second base 40 in different locations thereon, including, for example, at or near the distal end 44B or at or near the center.

More in particular, in at least one embodiment, the first fastener 25 and the third fastener 45 are coaxially aligned with one another, for example, as referenced by the axis A shown in FIG. 3A. This can provide increased durability and integrity of the assembly 10 as a whole and can reduce the force and pull exerted on one area of the assembly 10.

Furthermore, the third fastener 45 may be half of a snap fastener pair, such as female snap fastener or a male snap fastener. The third fastener 45 may be other fasteners as contemplated and included within the full spirit and scope of the present invention, such as, but not limited to, a button, half of a hook and loop type fastener (e.g., VELCRO®), a clip, a clasp, a clamp, etc.

More in particular, the third fastener 45 of at least one embodiment defines a second attachment portion of the assembly 10 and can be used to attach an accessory or item 160 to the interior of the garment 100. In accordance with at least one embodiment, in order to attach an accessory or item 160 to the third fastener 45, the accessory or item 160 includes a cooperative fastener 165, such as the second half of a snap fastener pair. As just an example, if the third fastener 45 is a female snap fastener, then the accessory 160 may include a cooperating male snap fastener that removably connects to the third fastener 45. In other embodiments, as described above, the third fastener 45 may include other structures, such as a button, hook and loop type fastener (e.g., VELCRO®), clips, clamps, etc. In such a case, the accessory fastener 165 is cooperative with the third fastener 45 to allow for the removable interconnected therewith.

Figure 4:
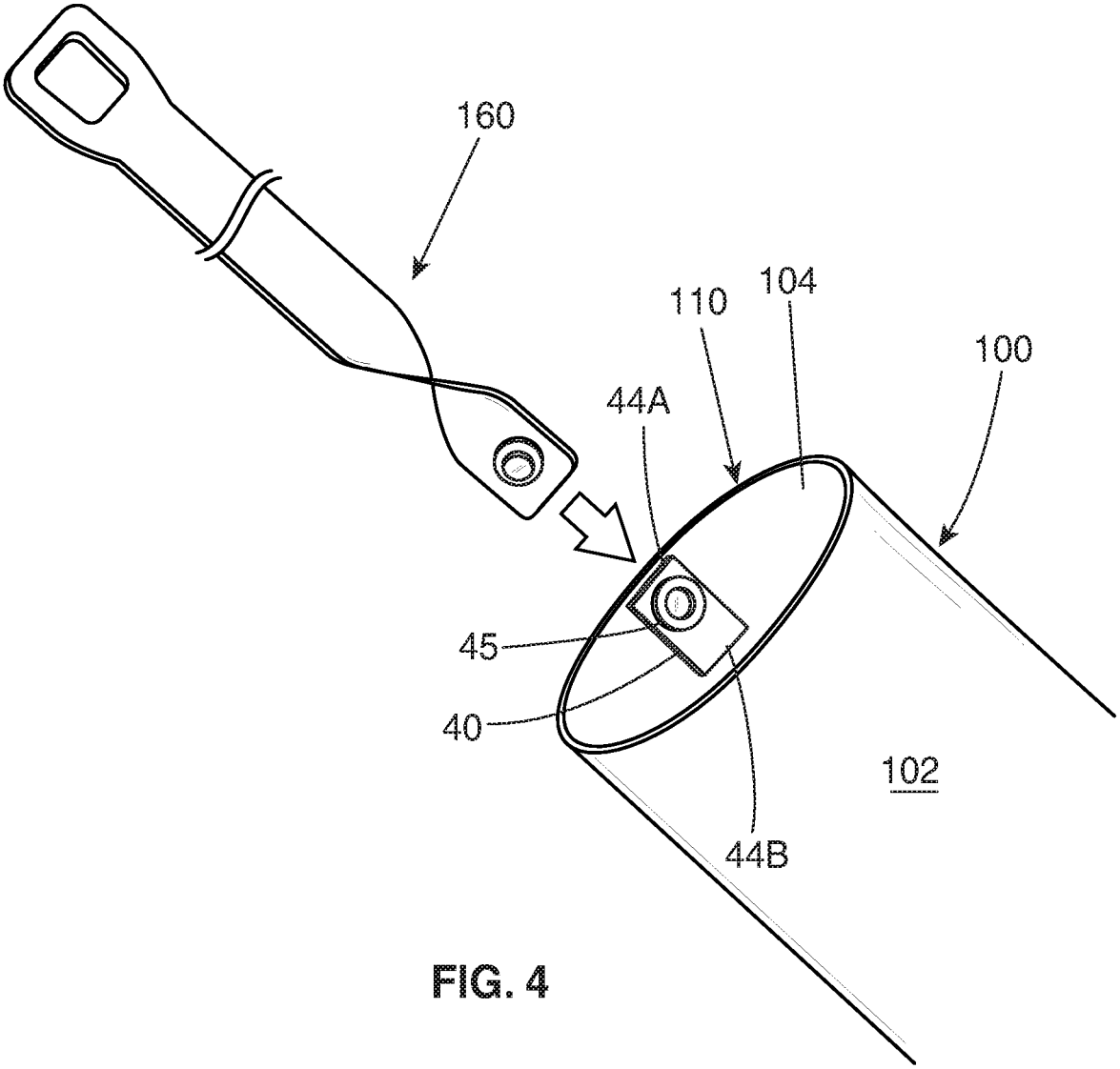
FIG. 4 is a bottom perspective view of the accessory attachment assembly with an accessory shown as being attachable to an interior of the garment.
Figure 5A:
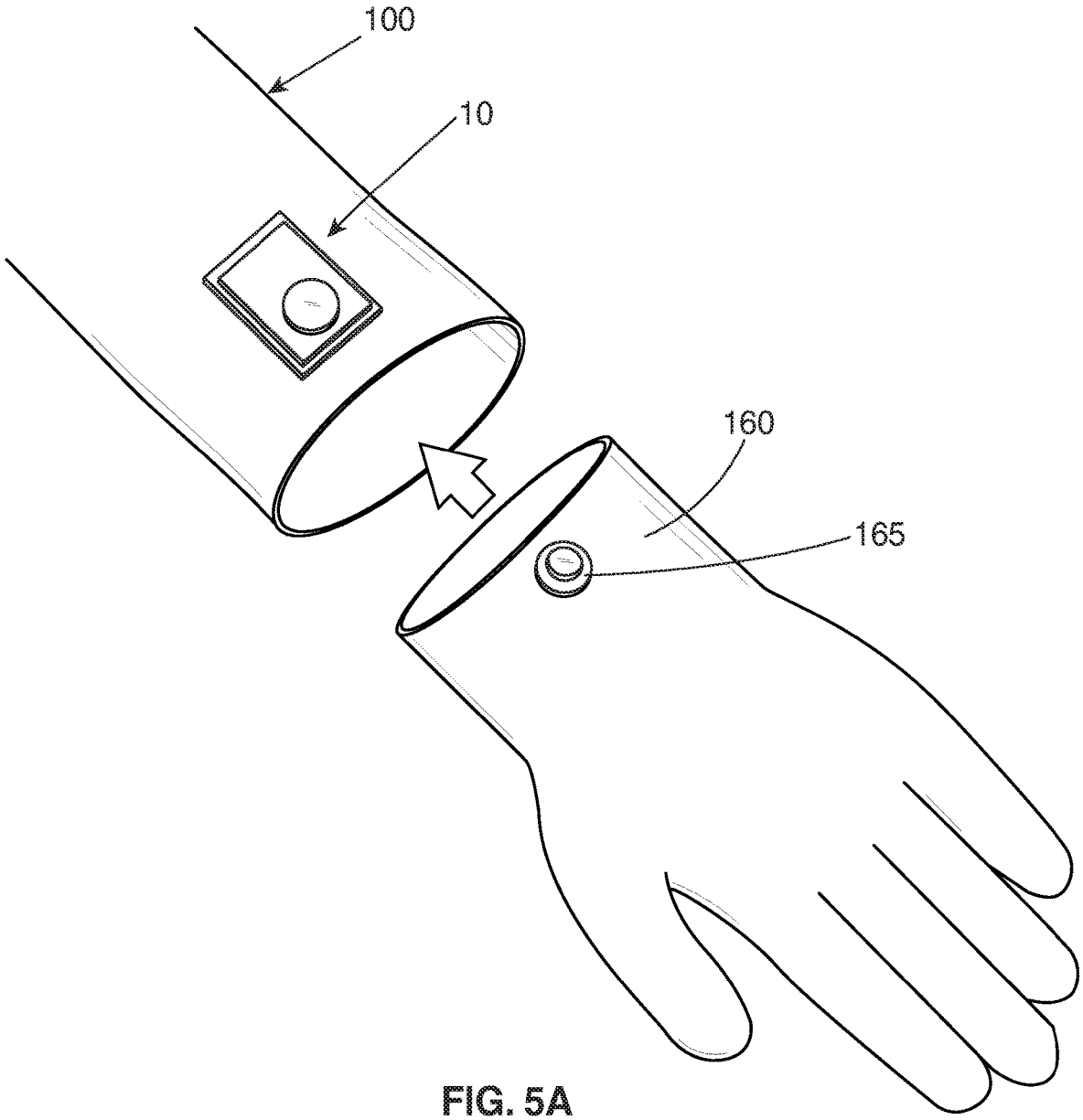
FIG. 5A is a top perspective view of the accessory attachment assembly with an accessory shown as being attachable to an interior of the garment.
Figure 5B:
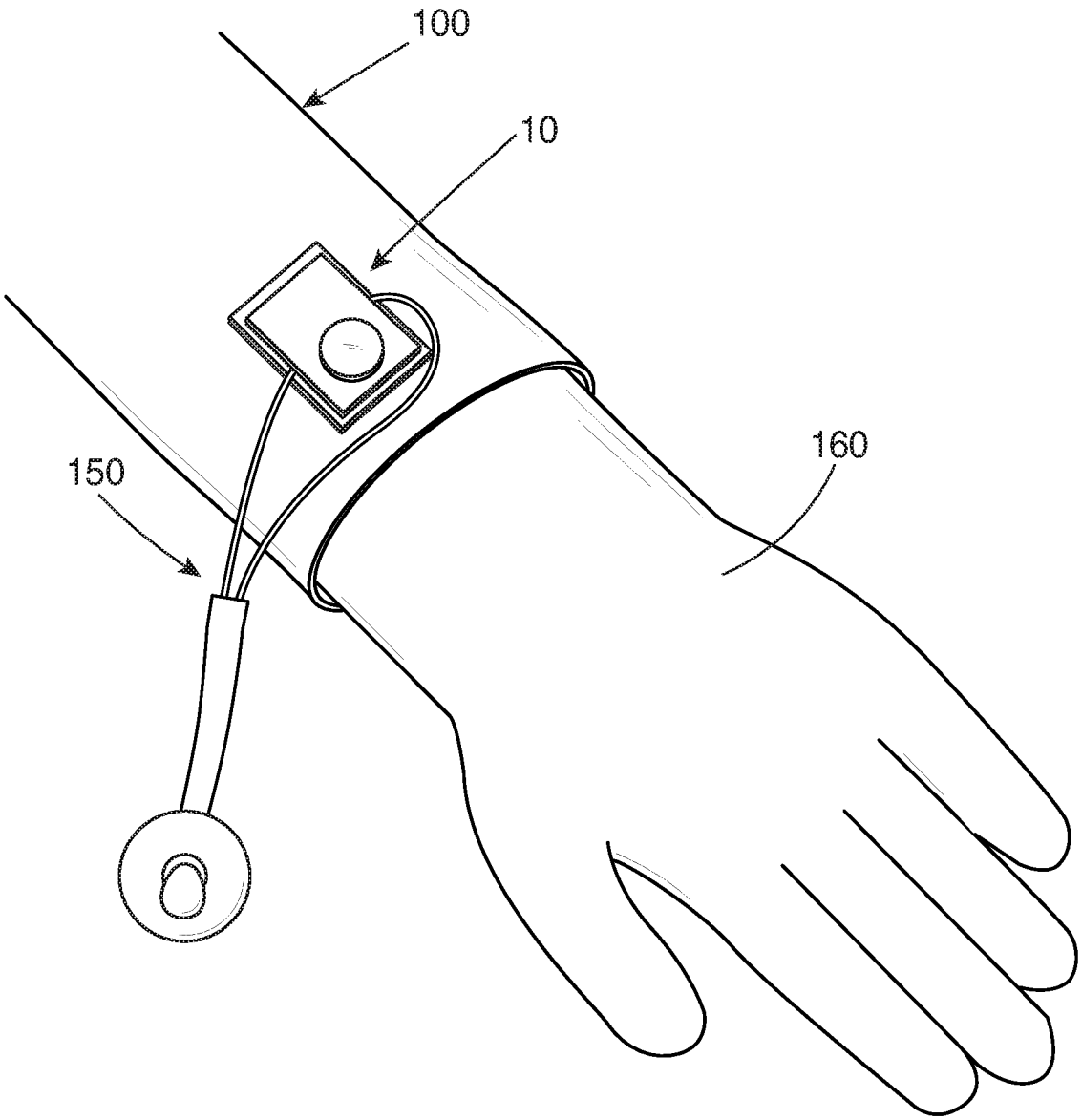
FIG. 5B is another top perspective view of the accessory attachment assembly with one accessory shown attached to the interior of the garment and another accessory attached to the exterior of the garment, as disclosed in accordance with at least one embodiment of the present invention.

Examples of accessories or auxiliary items that may attach to the third faster 45 of at least one embodiment may include, but are not limited to for example, a child leash (represented as 160 in FIG. 4), a glove or mitten (represented as. 160 in FIGS. 5A and 5B), decorative or novelty items or toys (e.g., a portion of a character peeking or extending from a pocket), etc. More in particular, as referenced in FIG. 5B, in at least one embodiment a plurality of accessories can be simultaneously attached to the assembly 10 of the present invention, for example, with at least one accessory 160 attached to the inside of the garment 100 (e.g., via fastener 45) while another accessory 150 is simultaneously attached to the exterior of the garment (e.g., via the formed loop defined by strap 30).

Figure 3C:
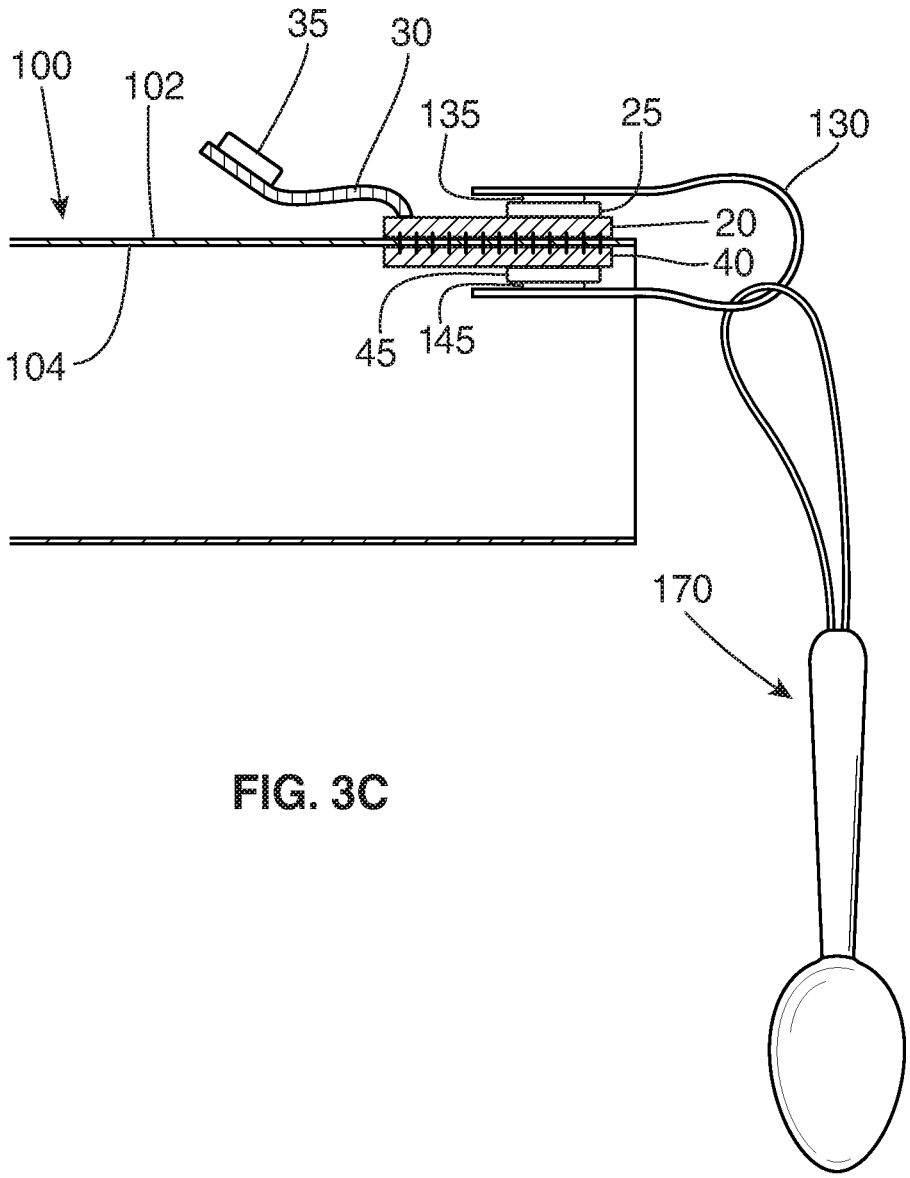
FIG. 3C is another cut away view of the accessory attachment assembly with an additional attachment loop extending from the first (external) fastener to the third (internal) fastener, as disclosed in accordance with at least one embodiment of the present invention.

Additionally, with reference to FIG. 3C, yet another embodiment of the present invention may include a connecting strap 130 that can extend between and connect to the outside fastener, such as the first fastener 25, and the inner fastener, such the third fastener 45. More in particular, the connecting strap 130 may include an elongated configuration which may but need not necessarily be similar in width and thickness as strap 30. Either way, the connecting strap 130 includes a length sufficient to extend between fasteners 25, 45 and to define a loop to which an accessory 170 can attach. For example, in the illustration of FIG. 3C, a spoon is attached to the loop defined by the connecting strap 130 by passing the connecting strap 130 through an opening or hole in the spoon (or other accessory) prior to closing the loop, or otherwise prior to connecting one or both ends of the connecting strap 130 to fasteners 25, 45.

More in particular, the connecting strap 130 includes fasteners 135, 145 which are cooperative with fasteners 25, 45. In many cases, the fasteners 135,145 are connected or fixed to opposing ends of the connecting strap 130. However, it is contemplated that the fasteners 125, 145 are connected to other locations along the length of the strap 130, particularly if the strap 130 is adjustable in length. Furthermore, connecting strap 130 may be made from or at least partially include a material with elasticity, such as, elastic, although other elastic or non-elastic materials are contemplated such as woven or non-woven fabrics or textiles, or even rope, cord, etc.

In any event, as just an example, in the case that first fastener 25 is a female snap fastener, cooperative fastener 125 of the connecting strap 130 is a cooperative male snap fastener. Similarly, in the case that third fastener 45 is a female snap fastener, then cooperative fastener 145 of strap 130 is a cooperative male snap fastener. As provided herein, other fasteners are contemplated within the full spirit and scope of the present invention, including but not limited to, hook and loop type fasteners (e.g., VELCRO®), clips, clamps, etc.

Moreover, still referring to FIG. 3C, the alignment or back-to-back placement of the first and third fasteners 25, 45, or otherwise the positioning of the bases 20, 40 in a back-to-back, opposite facing manner, as shown in the Figures, allows a connecting strap 130 to be used in the manner shown in FIG. 3C. Furthermore, the bases 20, 30 act as reinforcement layers which in many cases can absorb a large or greater amount of force exerted thereupon, for example, by a child tugging or pulling on a spoon or other accessory 170 attached thereto. In this manner, the connecting strap 130 may be used for heavier accessories or accessories upon which the child or other user may be inclined to pull or tug.

Figure 6:
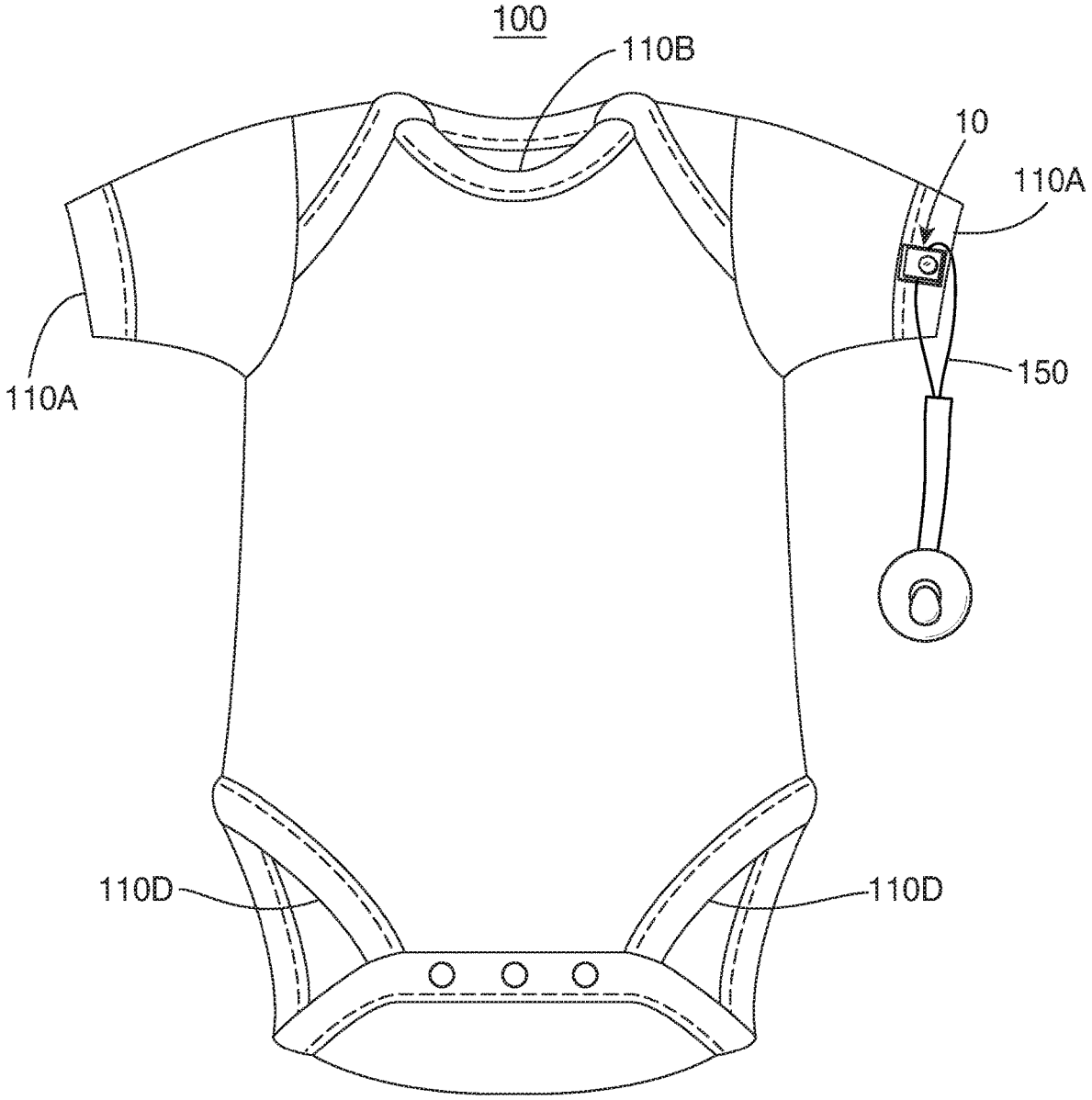
FIG. 6 is a front view of a garment as disclosed in accordance with at least one embodiment of the present invention with an accessory attachment assembly disposed proximate an arm opening thereof.
Figure 7:
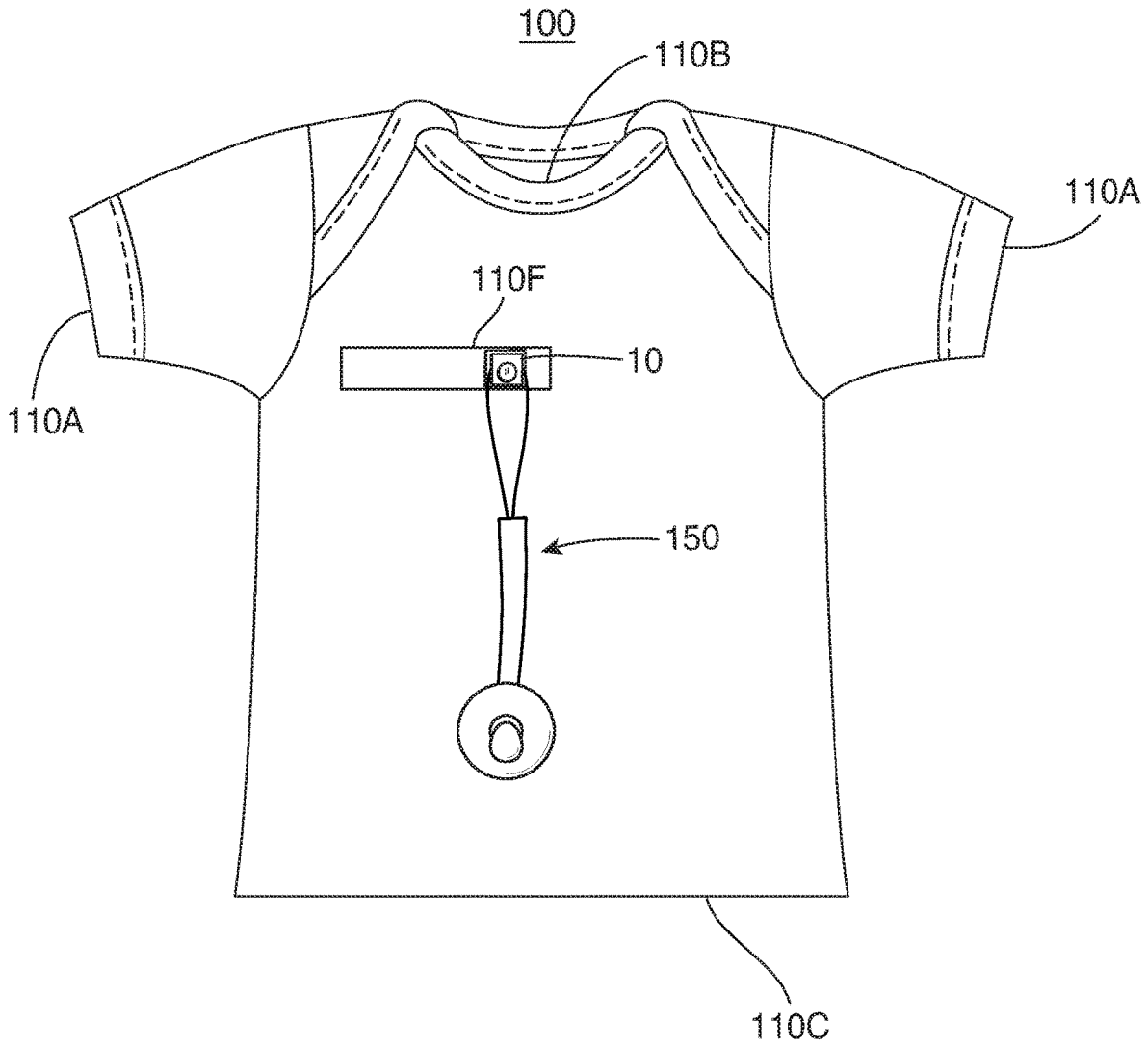
FIG. 7 is a front view of another garment as disclosed in accordance with at least one embodiment of the present invention with an accessory attachment assembly disposed proximate a pocket opening thereof.
Figure 8:
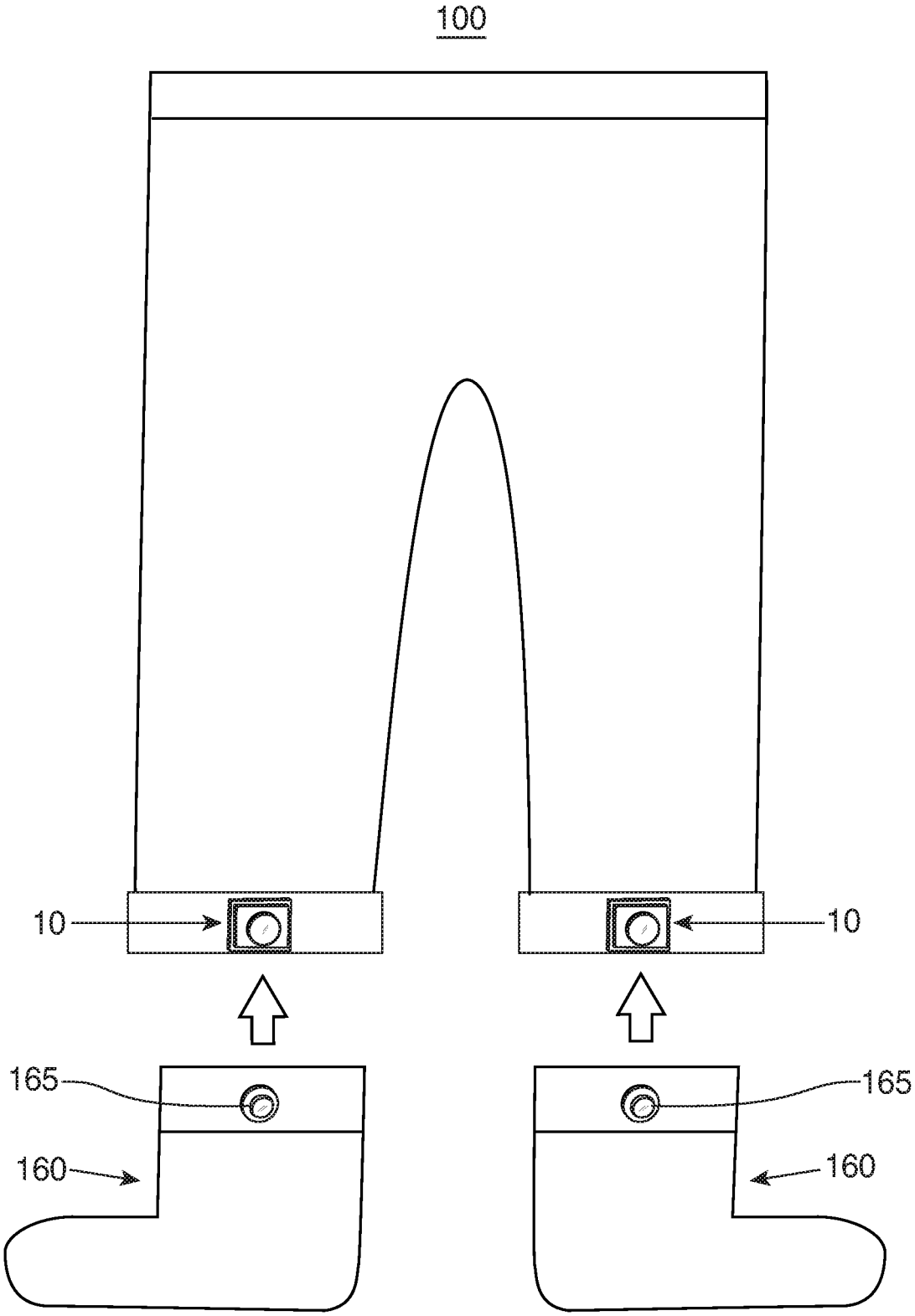
FIG. 8 is a front view of another garment as disclosed in accordance with at least one embodiment of the present invention with an accessory attachment assemblies disposed proximate lower leg openings thereof.

Referring now to FIGS. 6, 7 and 8, exemplary garments 100 are shown to illustrate the accessory attachment assembly 10 of certain embodiments of the present invention and its placement on the garment 100. More specifically, in at least one embodiment, the accessory attachment assembly 10 may be positioned on the garment 100 such that an end of the first base, such as a proximal end 24 thereof, and similarly an end of the second base, such as proximal end 34 thereof, is disposed adjacent or near an opening 110 of the garment 100. For instance, an opening 110 is defined as a location on the shirt where the inner surface 104 of the garment 100 meets the outer surface 102 of the garment 100 at an edge. The edge or opening 110 may define a sleeve opening 110A through which a wearer's arm will extend when the garment is properly worn, a neck line opening 110B through which a wearer's neck will extend when the garment is properly worn, a bottom hem or opening 110C through which a wearer's torso will typically extend when the garment is properly worn, upper leg opening 110D defined on certain onesies illustrated in FIG. 6, lower leg opening 110E defined on pants illustrated in FIG. 8, etc. Yet another opening of the garment as used herein, is a pocket opening 110F illustrated in FIG. 7, wherein the second base (not shown in FIG. 7) is disposed on an inner surface of the pocket.

In some cases, the garment 100 may include a cuff, hem or reinforced edge at or near an opening 110A-F. In those cases, the accessory attachment assembly 10 may be secured to the garment 100 directly on or at least partially on the cuff, hem or reinforced edge at or near the opening 110A-F. It is noted that while a portion of the accessory attachment assembly 10 (e.g., the proximal edges 24, 44 of the first and second bases 20, 40) may, but need not, be attached to the garment on the cuff, hem or reinforced edge, the distal ends 24, 44 of the bases 20, 40 may extend off of the cuff, hem or reinforced edge. In other embodiments, the entire attachment assembly 10 may be entirely on or entirely off of the cuff, hem or reinforced edge.

With reference to FIGS. 5 and 8, some embodiments of the present invention will allow for the secure attachment of gloves, mittens, or other hand-covering items (FIG. 5) and/or socks, booties, or other foot-covering items (FIG. 8) to the accessory attachment assembly 10 of the present invention, and in particular, to the second or inner attachment portion thereof. More specifically, the hand-covering or foot covering items may include a cooperative fastener 165 that removably attaches to the third fastener 45 of the accessory attachment assembly 10 of the present invention. This allows the hand-covering or foot-covering items to be secured to the clothing 100 in a manner that prevents or restricts the child or wearer from taking them off.

Furthermore, while the drawings illustrate one accessory attachment assembly 10 attached to each opening 110A-F, it is contemplated that more than one accessory attachment assembly 10 can be secured to the garment 100 at a single opening 110A-F. For example, a second attachment assembly 10 may be attached or fixed to the garment 100 directly opposite a first attachment assembly 10 or directly across the opening 110A-F. This not only provides additional places to externally secure toys, pacifiers, etc. but it can provide further attachment integrity to a hand-covering or foot-covering, which can include two (or more) cooperative fasteners 165, each connectable to a different one of a plurality of accessory attachment assemblies 10.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. An accessory attachment assembly for a garment, said accessory attachment assembly comprising:

a first base comprising a proximal end and a distal end, said first base being disposed on an exterior surface of the garment, a first fastener disposed on a top surface of said first base, a strap comprising a proximal end and a distal end, said strap further comprising a second fastener disposed adjacent to said distal end of said strap, said first fastener and said second fastener comprising cooperative configurations wherein said first fastener and said second fastener are removably connectable to one another, said strap being disposable between a closed position and an at least partially open position relative to said first base, wherein said strap and said first base define a closed loop when said strap is disposed in said closed position, a second base comprising a proximal end and a distal end, said second base being disposed on an interior surface of the garment and in at least partial alignment with said first base, and said second base comprising a third fastener disposed on an inner surface thereof.

2. The accessory attachment assembly as recited in claim 1 wherein said first fastener and said third fastener are coaxially aligned with one another.

3. The accessory attachment assembly as recited in claim 2 wherein said proximal end of said first base and said proximal end of said second base are disposed adjacent an opening of the garment.

4. The accessory attachment assembly as recited in claim 3 wherein said first base and said second base are attached to one another via a plurality of stitches disposed through said first base, the garment, and said second base.

5. The accessory attachment assembly as recited in claim 1 wherein said strap comprises an at least partial amount of lengthwise elasticity.

6. The accessory attachment assembly as recited in claim 1 wherein said first fastener and said second fastener collectively comprise a first snap fastener pair wherein one of said first fastener and said second fastener comprises a female snap fastener and wherein the other one of said first fastener and said second fastener comprises a male snap fastener.

7. The accessory attachment assembly as recited in claim 6 wherein said first fastener comprises a female snap fastener and wherein said second fastener comprises a male snap fastener.

8. The accessory attachment assembly as recited in claim 6 wherein said third fastener comprises one half of a second snap fastener pair.

9. The accessory attachment assembly as recited in claim 8 wherein said first fastener and said second fastener each comprise a female snap fastener.

10. An accessory attachment assembly for a garment, said accessory attachment assembly comprising:

a first base comprising a proximal end and a distal end, said first base being fixed to an exterior surface of the garment with said proximal end of said first base being adjacent an opening of the garment, a first snap fastener disposed on a top surface of said first base, a strap comprising a proximal end and a distal end, said proximal end of said strap being fixed to said first base adjacent said distal end of said first base, said strap further comprising a second snap fastener disposed adjacent to said distal end of said strap, wherein one of said first snap fastener and said second snap fastener comprises a female snap fastener and wherein the other one of said first snap fastener and said second snap fastener comprises a male snap fastener, said strap being disposable between a closed position and an at least partially open position relative to said first base, wherein said strap and said first base define a closed loop when said strap is disposed in said closed position, a second base comprising a proximal end and a distal end, said second base being fixed on an interior surface of the garment with said proximal end of said second base being adjacent the opening of the garment, and said second base comprising a third fastener disposed on an inner surface thereof.

11. The accessory attachment assembly as recited in claim 10 wherein said second base is disposed in alignment with said first base.

12. The accessory attachment assembly as recited in claim 11 wherein said first base and said second base are attached to one another via a plurality of stitches disposed through said first base, the garment, and said second base.

13. The accessory attachment assembly as recited in claim 12 wherein said strap comprises an at least partial amount of lengthwise elasticity.

14. The accessory attachment assembly as recited in claim 13 wherein said first fastener and said second fastener each comprise a female snap fastener.

15. An article of clothing comprising:

at least one accessory attachment assembly disposed adjacent an opening of the article of clothing, said accessory attachment assembly comprising:

a first base comprising a proximal end and a distal end, said first base being fixed to an exterior surface of the article of clothing with said proximal end of said first base being adjacent an opening of the article of clothing, a first snap fastener disposed on a top surface of said first base, a strap comprising a proximal end and a distal end, said proximal end of said strap being fixed to said first base adjacent said distal end of said base, said strap further comprising a second snap fastener disposed adjacent to said distal end of said strap, wherein one of said first snap fastener and said second snap fastener comprises a female snap fastener and wherein the other one of said first snap fastener and said second snap fastener comprises a male snap fastener, said strap being disposable between a closed position and an at least partially open position relative to said first base, wherein said strap and said first base define a closed loop when said strap is disposed in said closed position, a second base comprising a proximal end and a distal end, said second base being fixed an interior surface of the article of clothing with said proximal end of said second base being adjacent the opening of the article of clothing, and said second base comprising a third fastener disposed on an inner surface thereof.

16. The article of clothing as recited in claim 15 wherein said second base is disposed in alignment with said first base.

17. The article of clothing as recited in claim 16 wherein said first base and said second base are attached to one another via a plurality of stitches disposed through said first base, the article of clothing, and said second base.

18. The article of clothing as recited in claim 17 wherein said strap comprises an at least partial amount of lengthwise elasticity.

19. The article of clothing as recited in claim 18 wherein said first fastener and said second fastener each comprise a female snap fastener.

* * * * *